United States Patent [19]

Ignatowicz

[11] 4,170,073

[45] Oct. 9, 1979

[54] WIDE DYNAMIC RANGE MULTI-ZONE DRYING METHOD AND APPARATUS FOR CONTROLLING PRODUCT MOISTURE

[75] Inventor: Steven A. Ignatowicz, Wheeling, Ill.

[73] Assignee: Kay-Ray, Inc., Arlington Heights, Ill.

[21] Appl. No.: 856,239

[22] Filed: Dec. 1, 1977

[51] Int. Cl.[2] ..... F26B 3/04

[52] U.S. Cl. ..... 34/31; 34/48; 34/216; 131/135; 219/388; 219/498; 324/58.5 R

[58] Field of Search ..... 219/388 C, 388 W, 497, 219/498; 324/58.5 R, 58.5 A; 236/44 C; 34/46, 48, 22, 23, 31; 131/216, 135

[56] References Cited

U.S. PATENT DOCUMENTS

| | | | |
|---|---|---|---|
| 2,768,629 | 10/1956 | Maul | 131/135 |
| 3,119,560 | 1/1964 | Swaney | 34/48 |
| 3,564,724 | 2/1971 | Keyes et al. | 34/48 |
| 3,693,079 | 9/1972 | Walker | 324/58.5 A |
| 3,748,224 | 7/1973 | Tillie et al. | 162/252 |
| 3,801,426 | 4/1974 | Putman et al. | 34/48 |
| 3,815,254 | 6/1974 | Mills | 34/48 |
| 3,905,123 | 9/1975 | Fowler et al. | 34/46 |
| 3,906,196 | 9/1975 | Spitz | 34/43 |
| 4,043,050 | 8/1977 | Hancock | 34/48 |

*Primary Examiner*—John J. Camby
*Assistant Examiner*—Larry I. Schwartz
*Attorney, Agent, or Firm*—Steven H. Markowitz

[57] ABSTRACT

A method and apparatus is described for drying a product to a controlled moisture content. The apparatus comprising a first drying zone for receiving the product, a first regulating means for regulating the temperature within said first zone, a second drying zone for receiving the product from the first zone, a second regulating means for regulating the temperature within the second zone, means for measuring the moisture of the product after the product leaves the second zone, means for measuring the temperature in said first and second zones, means for controlling the second regulating means in response to the measured product moisture and the temperature of the second zone and means for cooperatively controlling the first regulating means in response to the measured product moisture and the temperature of the first zone.

23 Claims, 4 Drawing Figures

WIDE DYNAMIC RANGE MULTI-ZONE DRYING METHOD AND APPARATUS FOR CONTROLLING PRODUCT MOISTURE

BACKGROUND OF THE INVENTION

1. Field of the Invention

The invention is in the field of multi-zone drying systems particularly useful in controlling the final moisture content of a product leaving the final drying zone. The apparatus finds particular use in drying foods as for example animal feed such as dog food.

2. Description of the Prior Art

It is known within the prior art to utilize drying devices which are controlled by a programmable computer which receives input signals for controlling the final moisture content of the product. Single zone drying systems are shown, for example, in U.S. Pat. Nos. 3,905,123, 3,906,196 and 3,748,224. In aforementioned U.S. Pat. No. 3,905,123, for example, the moisture content of tobacco entering and leaving the dryer is measured and utilized together with a computer and a plurality of PID (proportional, integral, differential) controllers for regulating the dryer. Multi-zone drying systems are also known in the prior art as for example U.S. Pat. Nos. 3,564,724, 3,801,426, 3,815,254 and 2,768,629. The computing algorithms utilized in prior patents are designed to accomplish specific objectives with regard to the drying product as for example the moisture control curl compensation system of U.S. Pat. No. 3,564,724 or the caliper/production rate control for paper devices described in U.S. Pat. No. 3,801,426.

Within the technology of the food drying processes, particularly animal feed, drying machines have typically utilized laborious time consuming offline analysis of the moisture content of the final product which does not permit a real time adjustment in drying temperatures. Consequently, final product moisture content was apt to vary a great deal inasmuch as changes could be made only slowly and were not responsive to the present operating parameters at the time control was applied. Multi-zone drying systems typically utilize independent temperature adjustments for the different zones and depend a great deal upon the expertise and experience of the operator for obtaining a steady state operation with relatively constant final product moisture content.

Control of the final product moisture content is particularly critical in such areas as food products wherein too much moisture will cause rotting of the food as well as incorrect weight specifications when the product drys out in shipment. Drying the final product to a nominal moisture content often involves a great deal of wasted energy in the drying process with the necessity for increasing the drying time and temperature and thus decreasing plant production output and operating efficiencies.

SUMMARY OF THE INVENTION

It is therefore an object of the invention to provide an improved multi-zone drying apparatus and method for controlling the moisture content of a product.

A further object of the invention is to provide an improved control system for a two zone dryer for providing gross and fine drying control adjustment means to achieve a regulated and constant value of the moisture content of the final product.

A further object of the invention is to provide a multi-zone drying system wherein a first zone initially receives the product to be dryed and is utilized to provide a gross moisture adjustment within the final product whereas a second and subsequent zone is utilized for obtaining a fine adjustment of the final product moisture content. Means are provided for sensing the temperature of the first and second zones as well as for measuring the final moisture product value for regulating the temperature within the zones. Regulation of the two zones is done in a coordinated fashion such that the second zone is more quickly adjusted to respond to changes in the final moisture product value whereas the first zone is designed to respond to more long term changes in moisture product value. The feed product is delivered to the first heating zone from an extruder and conveyed from the first zone to the second zone in the drying apparatus. The first drying zone temperature control means is also made responsive to changes in parameters associated with the extruder such as the product feed rate and water and steam supply rates. Changes in these extruder parameters are applied as additional corrections to the temperature adjustment dictated by the final moisture product value and are utilized for governing the temperature of the first zone.

Yet another object of the invention is to provide a computer controlled multi-zone drying system wherein each zone is sensitive to the moisture content of the final produce and individually sensitive to the temperature within their respective zone. The control mechanism further provides for means for correcting the initial first heating zone temperature value to respond to changes in the product feed rate from an extruder, as well as to changes in the extruder water and steam flow rates.

Yet a further object of the invention is to utilize a computer controlled multi-zone dryer system which permits a real time monitoring of the moisture produce value and a real time means for adjusting the temperature in each zone to maintain a desired moisture value of the final product.

In its broadest aspects, the invention permits the drying of a product to a controlled moisture content and comprises a first drying zone for receiving the product, a first regulating means for regulating the temperature within the first zone, a second drying zone receiving the product from the first zone, a second regulating means regulating the temperature within the second zone, means for measuring the moisture in the product after the product leaves the second drying zone, means for measuring the temperature in the first and second drying zones, means for controlling the second regulating means in response to the measured product moisture and the temperature within the second zone and means for cooperatively controlling the first regulating means in response to the measured product moisture and the temperature within the first drying zone.

BRIEF DESCRIPTION OF THE DRAWINGS

These and other objects of the invention will become clear in reference to the specification taken in conjunction with the figures wherein.

DETAILED DESCRIPTION OF THE PREFERRED EMBODIMENT

Figure 1:
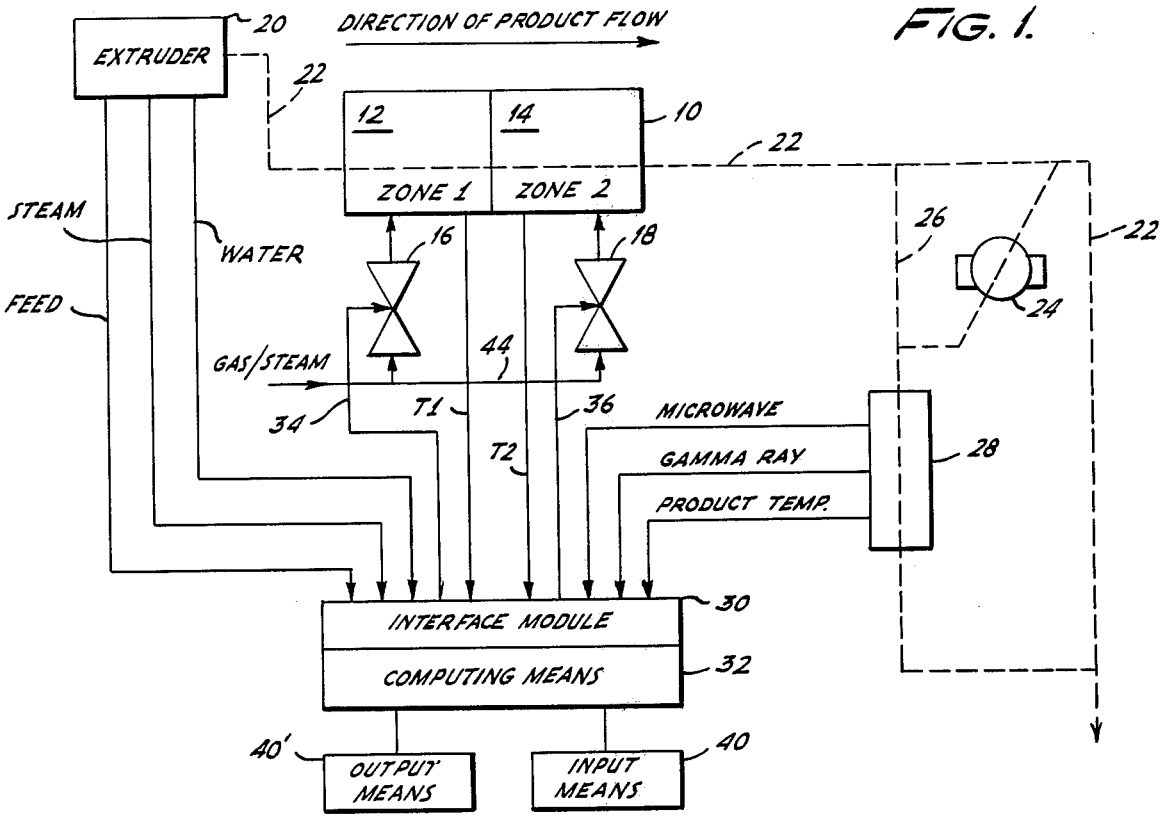
FIG. 1 is a block diagram showing the basic components of the drying apparatus.

As illustrated in FIG. 1, the apparatus comprises a dryer 10 having a plurality of at least two independently controllable regions or zones for heating material passing therethrough. Two zones are shown and designated by the numerals 12 and 14 corresponding to zone 1 and zone 2 respectively. The dryer 10 may be of conventional design and heated by means of steam or gas as supplied by regulating means 16 and 18 corresponding to valves 1 and 2 respectively. The product to be dried, such as animal food and the like, is passed from extruder or expander 20 into the first drying zone 1 and subsequently to the second drying zone 2 along a conventional conveyer defined by path 22. The conveyer may be driven for example by means of motor 24. A sample of the final product is taken along an auxiliary conveyer path 26 into a sample chamber 28. Sample chamber 28 is utilized to measure parameters used in computing the moisture content of the product and may, for example, be of the type described in co-pending application of Ivars Pakulis entitled "Microwave Moisture Sensor Chute," filed on or about Sept. 26, 1977, now U.S. Pat. No. 4,131,845 and assigned to the same assignee as herein. In order to determine moisture content in the final product three parameters are utilized as explained more fully below. A microwave energy sensor senses microwave energy transmitted through the sample product within sample chamber 28; a gamma ray sensor is utilized to detect gamma rays penetrating the final product; and the product temperature is sensed to provide a further input signal for performing the moisture calculation. Microwave, gamma ray and product temperature signals are fed to an interface module 30 which is connected to a computing means 32. Additional signals are also fed to interface module 30 such as the sensed parameters from the extruder 20, namely, the feed rate of the product, and steam and water flow values of the extruder. Output signals from the computing means 32 and interface module 30 are provided along lines 34 and 36 to control valves 1 and 2 respectively. Computing means 32 is also provided with an input means 40 which may for example be a keyboard and an output means 40' which may be a display panel such as a CRT for monitoring the drying process. Gas or steam utilized in the dryer 10 are fed from a source, not shown, along pipe lines 44 through the regulating means 16 and 18.

Figure 2:
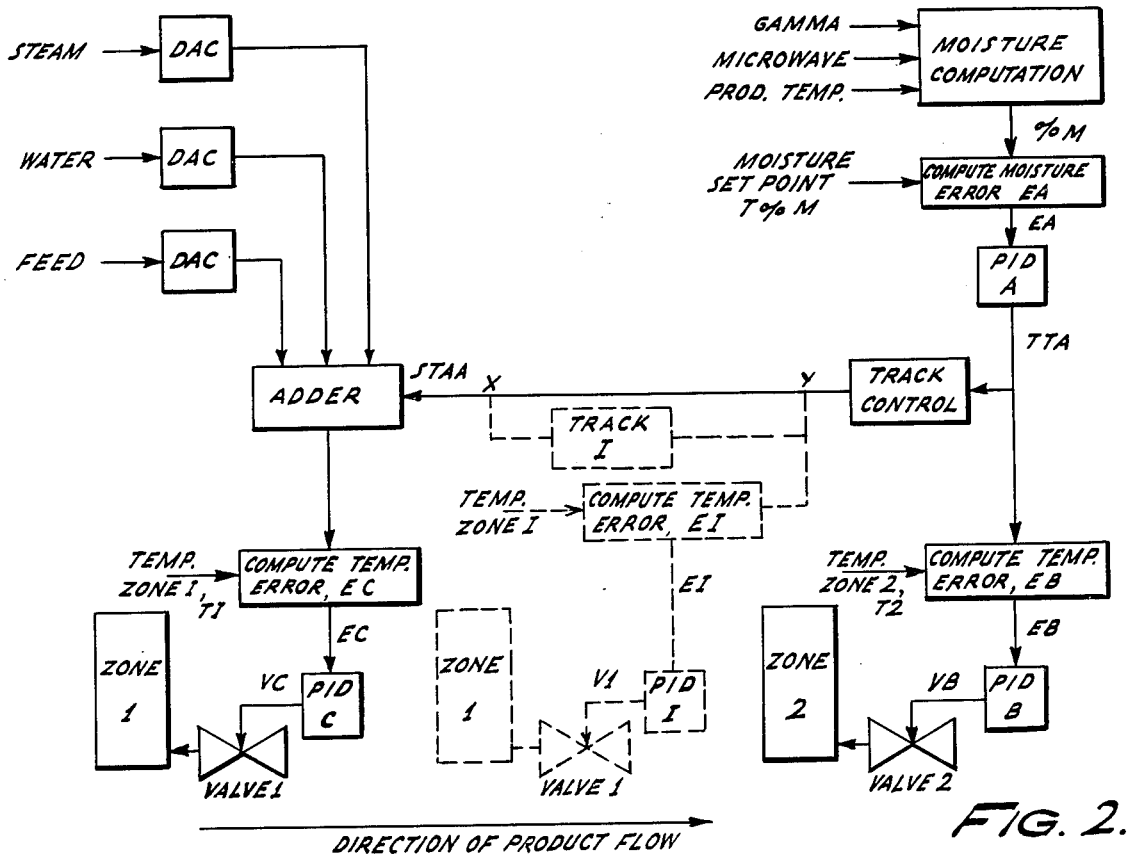
FIG. 2 is a block diagram showing the basic algorithm utilized in controlling the multi-zone drying system.

The details of the basic algorithms utilized in controlling the dryer in accordance with the invention are shown more fully in FIG. 2. Zone 1 of the dryer is the first zone to receive the extruded material from extruder 20 and is responsible for the major portion of the drying achieved within dryer 10. Zone 2 is utilized to fine tune the dryer 10 to achieve a much smaller change in moisture. As representative figures, the desired moisture content of the final food product may, for example, be on the order of 7%. The moisture content of the food product prior to entering zone 1 of the dryer is typically on the order of 20–30%. After exiting zone 1 of the dryer 10 the moisture content has been adjusted to a value on the order of 10%. Consequently, zone 1 of the dryer is effective to produce the major portion of the drying required whereas zone 2 is utilized to provide a sensitive and rapid adjustment of the moisture content but with rather limited dynamic range.

As illustrated in FIG. 2, signals are provided from the gamma ray, microwave and product temperature sensors and utilized in the computing means 32 to provide a percent moisture value indicative of the moisture content of the product as it leaves zone 2 of the dryer 10. As a first step in computing the moisture content the mass density of the product within the sample chamber 28 is determined utilizing equation (1) below:

$$MD = SLOPE1 \cdot (GVOLT - GREF) + OFFSET1 \quad (1)$$

Equation (1) represents a linear relationship between the mass density MD and the input voltage signal from the gamma ray detector GVOLT. The SLOPE1 and OFFSET1 values are determined from the slope and intercept of the straight line representing the linear function. The value GREF is a voltage value representative of an empty sample chamber condition and is utilized as a background reference voltage. After the mass density, MD, has been determined the water density, WD, is calculated in accordance with the following equation.

$$WD = SLOPE2 \cdot LOG(MW) + OFFSET2 \quad (2)$$

The SLOPE2 and OFFSET2 values are constants derived from the log function of the water density versus microwave input, MW, (volts) function. The value MW is representative of the intensity of the microwave energy received from the microwave sensor during the measurement time.

The product temperature TC is then determined utilizing equation (3) below wherein PTVOLT is the measured temperature value derived from the temperature sensor within the sample chamber 28, and AVPTVOLT is a constant representative of the average product temperature output value in volts. The product temperature TC typically spans a range of 0–10 volts.

$$TC = SLOPE3 \cdot (PTVOLT - AVPTVOLT) \quad (3)$$

The percent moisture is calculated as a function of the variables MD, WD and TC as given in equation (4) below:

$$\%M = 100 \cdot (WD + TC)/MD \quad (4)$$

An error signal is then determined by comparing the measured moisture content, %M, with the desired moisture setpoint target T%M. The error signal, EA, is simply given as the difference:

$$EA = \%M - T\%M \quad (5)$$

where T%M is the desired moisture setpoint which may typically be on the order of 7%.

The error value EA is then utilized in a PID (proportional, integral, differential) controller identified in FIG. 2 as PIDA. PIDA supplies an output value TTA for the desired target temperature in accordance with the well known formula $$TTA = GA \cdot EA + (GA/TA) \int EA\, dt + GA \cdot RA\, d(\%M)/dt \quad (6)$$

where GA is the loop gain constant which is determined by the amount of change in temperature needed to change the moisture by 1%; TA is determined by one-half of the time in which the product spends in the controlled portion of the dryer under consideration (a constant value); and RA is a constant usually emperically determined as appropriate for the differential term in the PID formula. Typically, RA is much less than unity. The output value of TTA is constrained to be below a predetermined maximum value as for example 300° F. This constraint is imposed to insure that the product is not overheated within zone 2. As a consequence, zone 1 must be used to provide additional drying in the event the temperature in zone 2 reaches its maximum value.

The output signal TTA for the target temperature value from PIDA is utilized for controlling the temperature in both zone 1 and zone 2 of the dryer. Zone 2 is, however, much more sensitive to variations in the value of TTA. To achieve temperature control of zone 2 the TTA signal is fed to a second PID controller, identified as PIDB, in the form of a difference or error signal using the temperature value measured for zone 2. Thus, an error signal, EB, is derived from the following formula:

$$EB = T2 - TTA \tag{7}$$

where T2 is the temperature as measured in zone 2. The error signal EB is then utilized in PIDB to provide an output signal VB in accordance with the following equation which is similar to equation (6) above:

$$VB = GB \cdot EB + (GB/TB) \int EB\, dt + GB \cdot RB\, d(T2)/dt \tag{8}$$

The values GB, TB and RB are constants defined as above with reference to equation (6). (The suffixes A, B and C on these constants correspond to PID controllers A, B and C respectively.) The value VB is utilized to control valve 2 and consequently the temperature within zone 2.

The output of the PIDA controller, TTA, is also utilized for controlling valve 1. To this end, the output TTA is fed to a TRACK controller which is utilized to track or effectively scale the TTA signal. The TRACK controller operates in accordance with the following equation:

$$STTA = STTA + ((SLOPE4 \cdot TTA + OFFSET4) - STTA)/TIME \tag{9}$$

The value of STTA on the right hand side of the equation is the old value of the scaled TTA output (STTA) whereas the value of STTA on the left hand side of the equation is the new value determined when the computing means actually executes equation (9). Consequently, equation (9) is written in computer form where it is understood that a new value of STTA is to be derived from the most recent prior value of the same variable. The variable TIME is a constant which is selected to be long in relation to the time the product spends in zone 2 of the dryer. For example, the value of TIME may be three to four times the value of the time the product spends in dryer zone 2. Values of this magnitude are selected to effectively decouple any fast temperature response of zone 1 as a consequence of changing moisture in the final product. In this sense zone 1 has a slower response time to moisture variations than zone 2 and responds to larger product moisture changes or to changes in moisture which have a longer average effect. Obviously, however, the temperature in zone 1 can be scaled lower then, higher than, or equal to the temperature in zone 2.

The output STTA from the track control is then fed to an adder wherein corrections are made for any front end disturbances of the dryer which may effect the overall control process. For example, changes in the water flow, steam flow and raw product feed of the extruder are measured and fed to direct acting controllers (DAC) each of which provides a correction value to the signal STTA. Typically, the correction values are quite small. Each of the direct acting controllers operate in accordance with equation (10) as follows:

$$LAG = ((LAG + dIa/dt) \cdot (LGT - 1) + dIa/dt)/LGT \tag{10a}$$

$$LEAD = (LEAD \cdot (LDT - 1) + LAG)/LDT \tag{10b}$$

$$DAC_a = DAC_a + LEAD \cdot GAIN \tag{10C}$$

The index "a" takes on values between 1 and 3 such that $I_1$ is representative of the extruder steam flow, $I_2$ is representative of the extruder water flow and $I_3$ is representative of the extruder product feed. Rates of change of these parameters are utilized in the DAC computation as seen in equation (10). The values LDT and LGT are constants as is the value GAIN which is utilized as a scale constant to convert into degrees farenheit. LDT is a time constant representative of the lead time necessary before a full correction is applied and is determined by the travel time of the feed product through zone 1. LGT is the lag time constant required the DAC action to decay toward zero and is determined by the travel time throughout the entire dryer 10. The corrected signal, CTTA, at the output of the adder is simply given by, $$CTTA = \sum_{a=1}^{3} DAC_a + STTA \tag{11}$$

wherein the effect of all of the corrections because of variations in steam, water and feed rates are added (or subtracted, depending on sign) to give the final value CTTA.

A third PID controller, PIDC, is utilized to provide the correct voltage signal for controlling valve 1. For this purpose, an error signal is derived by subtracting the value CTTA from the measured value, T1, of the temperature within zone 1 as follows:

$$EC = T1 - CTTA \tag{12}$$

Again, the error signal EC is utilized in the proportional, integral, differential controller, PIDC, in accordance with equation (13) as follows:

$$VC = GC \cdot EC + (GC/TC) \int EC\, dt + GC \cdot RC\, d(T1)/dt \tag{13}$$

The output signal VC is applied to valve 1 for controlling the temperature in zone 1.

The governing algorithm illustrated in FIG. 2 is particularly important in the two zone control system of the invention in order to increase the dynamic range and response time of the apparatus. In particular, with single zone systems it is often not possible to obtain the desired moisture value without raising the temperature of the heating device such that the food product is burned or seriously damaged. Consequently, the two zone system is much more advantageous and enables a much larger dynamic range of the dryer as a whole. In practice, it is desirable to have zone 1 responsive to the target temperature as determined from the PIDA controller for example, but to have a lesser degree of sensitivity than zone 2 to the same variable. The TRACK controller thus serves to somewhat decouple the two zones in order to prevent overcompensation by zone 1 to small, short range changes in the final product moisture.

The basic algorithm described above may readily be expanded to multi-zone drying systems as represented by the inclusion of one or more additional drying zones positioned inbetween drying zones 1 and 2. One such intermediate drying zone (zone I) is illustrated in phantom lines, and connected between points X and Y in FIG. 2. In operation, the solid connecting line between points X and Y is deleted and replaced by the intermediate network including a means for measuring the temperature of zone I, means for computing the intermediate error signal, EI, from the difference between the measured intermediate signal and the STTA signal, means for performing a PID calculation (via PIDI) for providing an output signal VI, and an intermediate valve (valve I) for regulating the heat in drying zone I. The equations governing the operation of the drying zone I are analogous to those above for zones 1 and 2. It is noted that when employing an intermediate drying zone an additional TRACT I controller is utilized to decouple the intermediate zone from the next adjacent upstream zone be it zone 1 or yet additional intermediate drying zones. Thus, the response of each drying zone is somewhat decoupled from adjacent zones although all zones cooperatively operate in response to the moisture content of the product to control same. The response of zone 2 to the moisture content of the product is derived from the target temperature TTA, whereas the response of the intermediate zone I (as well as zone 1) is derived from a scaled-down value of the target temperature TTA (via TRACK). It is evident that the intermediate zone or zones (as well as zone 1) are effectively responsive to a scaled-down value of the moisture content of the product inasmuch as TTA is itself dependent on the moisture content and scaling down TTA is equivalent, for this purpose, to scaling down the measured value of the moisture content, or, more accurately, the difference between the measured product moisture value and the desired setpoint value.

Figure 3:
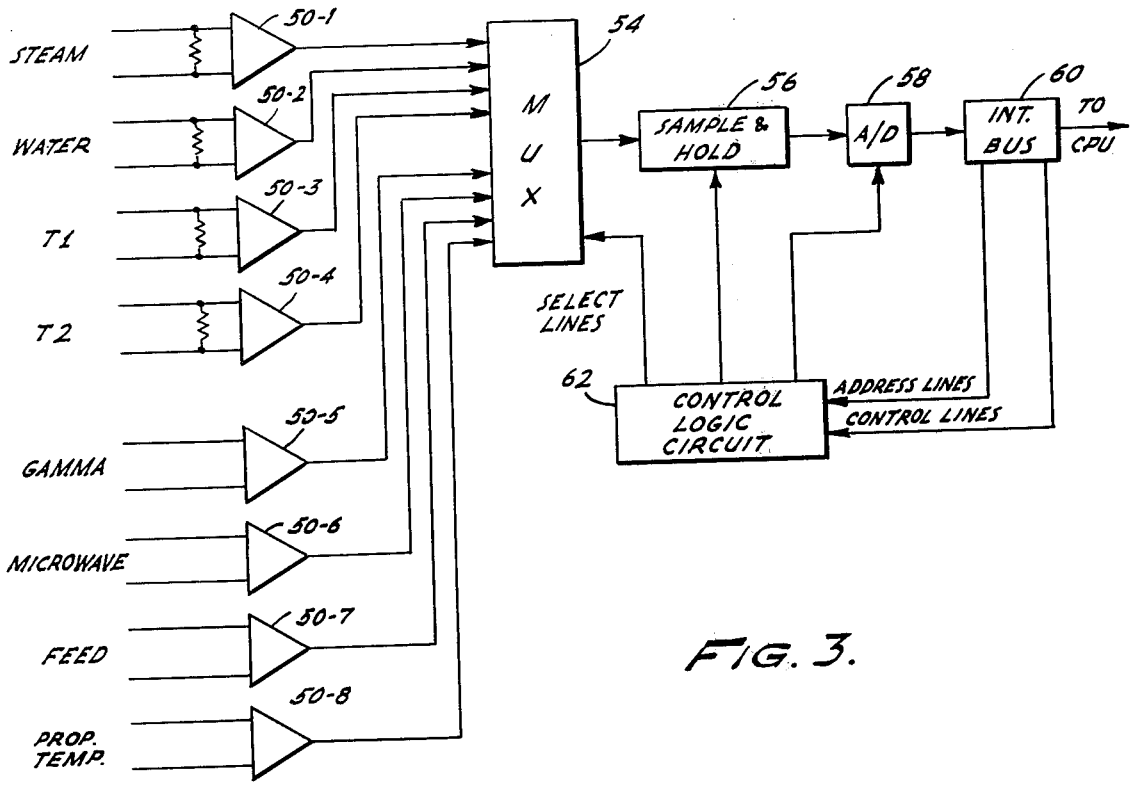
FIG. 3 is a block diagram of the analog input interface utilized in accordance with the invention.

The computing algorithm illustrated in FIG. 2 is implemented by means of computing means 32 which may, for example, be a general purpose programmable digital computer as for example the Zilog 8080 MCS. The computing means is programmed to carry out the formulas given above. Details of the interface module 30 are shown in FIGS. 3 and 4 wherein FIG. 3 shows the analog input interface and FIG. 4 shows the output interface.

Analog input signals are provided as current or voltage signals from the various sensors employed. Steam and water flow sensors as well as the temperature sensors employed in zones 1 and 2 supply output current signals on the order of 4 to 20 ma. These sensor signals are fed as differential input signals to instrumentation amplifiers 50-1 through 50-4 such as, for example, Model No. AD571, manufactured by Analog Devices. The microwave and gamma ray detectors together with the tachometer product feed signal are supplied as voltage signals on the order of 0 to 10 volts. Additionally, the product temperature signal PTVOLT (equation (3) above) is supplied as a voltage signal from a temperature sensitive device, Model LX5700 supplied by National Semiconductor. These output signals are fed to additional instrumentation amplifiers 50-5 through 50-8. The output of all of the instrumentation amplifiers, 50-1 through 50-8, are fed to a multiplexer 54 as for example, Model No. AD7501. A sample and hold circuit 56 (for example, Model No. LH0053C supplied by National Semiconductor) is utilized to sample and hold a selected analog signal from the multiplexer 54 while the signal is being converted into digital form by means of an A/D converter 58. Output data from the A/D converter 58 is fed to the computer interface bus 60 (for example, Intel Model No. 8212) for subsequent feeding to the CPU of the computing means 32. Address and control signals are supplied to a control logic circuit 62 which contains conventional decoding means for decoding the addresses, comparison means for comparing the addresses to selected hardwire addresses associated with the individual sensor inputs and means for generating the required strobing signals to the multiplexer 54, sample and hold circuit 56 and a A/D converter 58.

Figure 4:
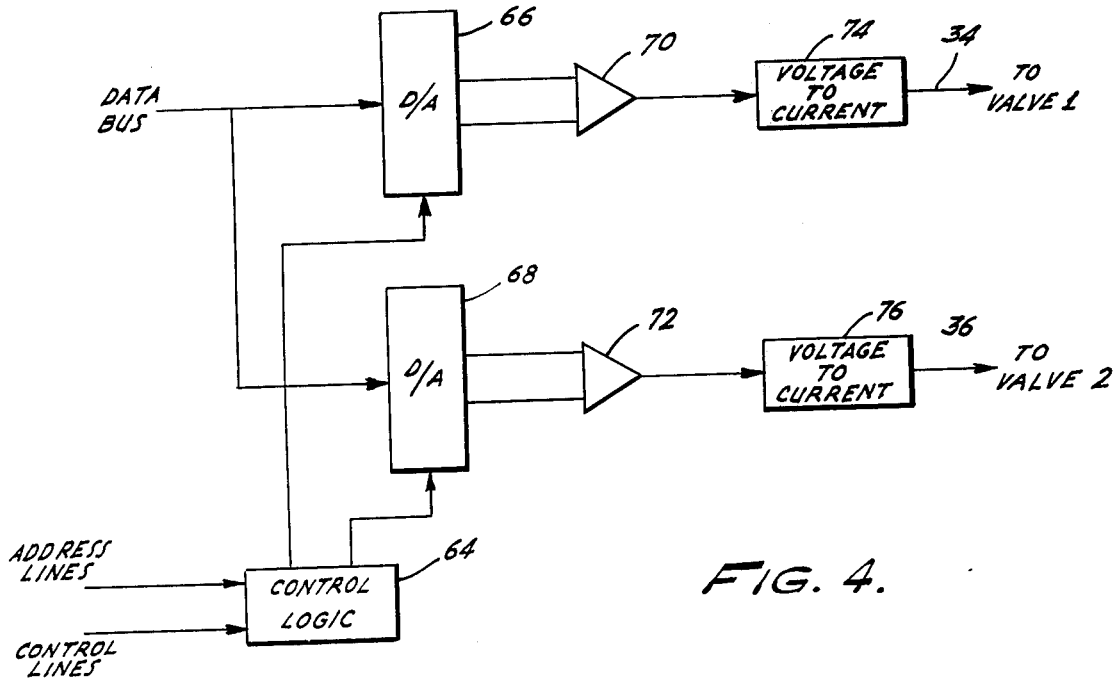
FIG. 4 is a block diagram of the analog output interface utilized in accordance with the invention.

The analog output interface as illustrated in FIG. 4 comprises a control logic circuit 64 for selecting the address for the output data and for strobing digital to analog converters/data latches 66 and 68 (as for example, Model AD7522) to latch and convert the CPU output data into analog form. The output of the D/A converters/data latches 66 and 68 are fed to buffer amplifiers 70 and 72, for example, Model 8741, which are utilized to provide a 0 to 10 volt output signals. The output voltage signals are then converted into 4 to 20 ma current signals by means of voltage to current converters 74 and 76 which thereby provide controlling current to the fuel control valves 1 and 2 along lines 34 and 36 respectively.

Although the invention has been described in terms of a selected preferred embodiment, the invention should not be deemed limited thereto, since other embodiments and modifications will readily occur to one skilled in the art. It is therefore to be understood that the appended claims are intended to cover all such modifications as fall within the true spirit and scope of the invention.

What is claimed is:

1. Apparatus for drying a product to a controlled moisture content comprising:

(a) a first drying zone for receiving said product, (b) first regulating means for regulating the temperature within said first zone, (c) a second drying zone for receiving said product from said first zone, (d) second regulating means for regulating the temperature within said second zone, (e) means for measuring the moisture in said product after said product leaves said second drying zone, (f) means for measuring the temperature in said first and second zones, (g) means for controlling said second regulating means in response to said measured product moisture and measured temperature of said second zone, and (h) means for cooperatively controling said first regulating means in response to said measured product moisture and the measured temperature of said first zone, wherein said product enters said first drying zone from a product extruder and said means for controlling said first regulating means further comprises means responsive to said extruder product feed rate for applying an additional control of said first regulating means.

2. Apparatus as recited in claim 1 wherein said first and second regulating means comprise valve means and each of said controlling means comprises a PID computing means.

3. Apparatus as recited in claim 2 wherein said computing means further computes the moisture content of said product from gamma ray, microwave and temperature measurement input values.

4. Apparatus as recited in claim 1 wherein said means for controlling said first regulating means is further responsive to water and steam flow rates associated with said extruder.

5. Apparatus as recited in claim 1 wherein said means for controlling said second regulating means controls same in response to a target temperature derived from a difference value between the measured product moisture and a desired set-point product moisture, and said means for controlling said first regulating means controls same in response to a scaled down value of said target temperature, whereby said first drying zone responds slower to changes in said target temperature than said second drying zone.

6. Apparatus as recited in claim 5 wherein said target temperature is derived from said differenc value from a PID computing means of said means for controlling said second regulating means.

7. Apparatus as recited in claim 6 wherein said target temperature and said scaled down value of said target temperature are passed each through additional PID computing means for controling said first and second regulating means respectively.

8. Apparatus as recited in claim 7 further comprising at least one intermediate drying zone positioned inbetween said first and second drying zones, means for sensing the temperature of said intermediate zone, means for regulating the temperature within said intermediate zone and means for controlling said intermediate regulating means in response to the sensed temperature of said intermediate zone and the measured product moisture.

9. Apparatus as recited in claim 8 wherein said means for controlling said intermediate regulating means controls same in response to an intermediately scaled down version of said target temperature, whereby said intermediate drying zone responds slower to changes in target temperature than said second drying zone but faster to changes in target temperature than said first drying zone.

10. Apparatus as recited in claim 9 wherein said product enters said first drying zone from a product extruder and said means for controlling said first regulating means further comprises means responsive to said extruder product feed rate for applying an additional control of said first regulating means.

11. Apparatus as recited in claim 10 wherein said means for controlling said first regulating means is further responsive to water and steam flow rates associated with said extruder.

12. Apparatus as recited in claim 11 wherein said first, second and intermediate regulating means each comprise valve means.

13. Apparatus as recited in claim 12 wherein said means for controlling said first, second and intermediate regulating means comprises a programmable digital computing means.

14. Apparatus as recited in claim 1 further comprising at least one intermediate drying zone positioned inbetween said first and second drying zones, means for sensing the temperature of said intermediate zone, means for regulating the temperature within said intermediate zone and means for controlling said intermediate regulating means in response to the sensed temperature of said intermediate zone and the measured product moisture.

15. A method of drying a product to a controlled moisture content comprising the steps of:

(a) receiving said product to be dried in a first drying zone, (b) transporting said product through said first drying zone and, subsequently, through a second drying zone, (c) measuring the moisture content of said product leaving said second drying zone, (d) measuring the temperature of said first and second zones, and (e) automatically and cooperatively adjusting the temperature of said first and second drying zones in response to said measured moisture content and said measured temperatures, wherein said product is delivered to said first drying zone from an extruder, wherein the product feed rate of said extruder is measured, and wherein the temperature of said first drying zone is additionally adjusted in response to said product feed rate.

16. A method as recited in claim 15 wherein said adjusting step comprises the steps of:

(a) adjusting the temperature of said second drying zone in response to the measured moisture content of said product and measured temperature of said second drying zone, and (b) adjusting the temperature of said first drying zone in response to a scaled down version of said measured moisture content of said product and said measured temperature of said first zone, whereby said first drying zone responds slower to changes in said product moisture content than said second drying zone.

17. A method as recited in claim 16 further comprising the steps of:

transporting said product through a drying zone positioned intermediate said first and second drying zones, measuring the temperature of said intermediate drying zone and adjusting the temperature of said intermediate drying zone in response to said measured moisture content and said measured temperature of said intermediate drying zone.

18. A method as recited in claim 17 further comprising the step of adjusting the temperature of said intermediate drying zone in response to an intermediate scaled down value of said measured moisture content of said product.

19. A method as recited in claim 15 further comprising the steps of:

transporting said product through a drying zone positioned intermediate said first and second drying zones, measuring the temperature of said intermediate drying zone and adjusting the temperature of said intermediate drying zone in response to said measured moisture content and said measured temperature of said intermediate drying zone.

20. A method as recited in claim 15 further comprising the steps of:

drying said product in said first drying zone to reduce said product moisture content by a substantial amount thereby providing a coarse moisture adjustment and drying said product in said second drying zone to reduce said product moisture by a minor amount thereby producing a fine moisture adjustment.

21. A method of drying a product to a controlled moisture content comprising the steps of:

(a) receiving said product to be dried in a first drying zone, (b) transporting said product through said first drying zone and, subsequently, through a second drying zone, (c) measuring the moisture content of said product leaving said second drying zone, (d) measuring the temperature of said first and second zones, and (e) automatically and cooperatively adjusting the temperature of said first and second drying zones in response to said measured moisture content and said measured temperatures, wherein said product is delivered to said first drying zone from an extruder, wherein the water flow rate of said extruder is measured, and wherein the temperature of said first drying zone is additionally adjusted in response to said water flow rate.

22. A method of drying a product to a controlled moisture content comprising the steps of:

(a) receiving said product to be dried in a first drying zone, (b) transporting said product through said first drying zone and, subsequently, through a second drying zone, (c) measuring the moisture content of said product leaving said second drying zone, (d) measuring the temperature of said first and second zones, and (e) automatically and cooperatively adjusting the temperature of said first and second drying zones in response to said measured moisture content and said measured temperature, wherein said product is delivered to said first drying zone from an extruder, wherein the product steam flow rate of said extruder is measured, and wherein the temperature of said first drying zone is additionally adjusted in response to said steam flow rate.

23. A method as recited in claim 22 further comprising the steps of:

(a) measuring the product feed rate and water flow rate from said extruder, and (b) additionally adjusting the temperature of said first drying zone in response to said product feed and water flow rates.

* * * * *